United States Patent [19]

Quinton et al.

[11] Patent Number: 4,718,724

[45] Date of Patent: Jan. 12, 1988

[54] LUMBAR SUPPORT FOR SEAT ATTACHMENT

[75] Inventors: Myron Quinton, Auburn Hills, Mich.; Sharon Weiselfish, West Hartford, Conn.

[73] Assignee: Orthops Incorporated, Auburn Hills, Mich.

[21] Appl. No.: 937,496

[22] Filed: Dec. 3, 1986

[51] Int. Cl.[4] ..... A47C 3/00

[52] U.S. Cl. ..... 297/284; 297/230; 297/231

[58] Field of Search ..... 297/284, 230, 231, 452, 297/353

[56] References Cited

U.S. PATENT DOCUMENTS

| | | | |
|---|---|---|---|
| Re. 27,176 | 9/1971 | Froelich | 297/284 |
| 1,007,985 | 11/1911 | Smith | 297/284 |
| 1,444,536 | 2/1923 | Boyce | 297/230 X |
| 2,591,306 | 4/1952 | Sherman | 297/230 X |
| 2,756,808 | 7/1956 | Eichorst | 297/230 X |
| 2,867,266 | 1/1959 | Volger | 297/230 X |
| 3,086,817 | 4/1963 | Wilfert | 297/284 |
| 3,446,531 | 5/1969 | Froelich | 297/284 |
| 3,495,871 | 2/1970 | Resag et al. | 297/284 |
| 3,974,827 | 8/1976 | Bodeen | 297/284 X |
| 4,534,593 | 8/1985 | Ojala | 297/284 |
| 4,634,176 | 1/1987 | Scott | 297/284 X |

FOREIGN PATENT DOCUMENTS

| | | | |
|---|---|---|---|
| 1350522 | 12/1963 | France | 297/231 |
| 465170 | 4/1937 | United Kingdom | 297/231 |

*Primary Examiner*—Kenneth J. Dorner
*Assistant Examiner*—Laurie K. Cranmer
*Attorney, Agent, or Firm*—Lloyd M. Forster

[57] ABSTRACT

Adjustable lumbar support for attachment to car and other types of seat backs including a vertically adjustable concealed lumbar support cusion.

4 Claims, 7 Drawing Figures

LUMBAR SUPPORT FOR SEAT ATTACHMENT

BACKGROUND OF THE INVENTION

Extensive scientific research has been directed to back rest design for chairs and car seats with reference to optimizing lumbar support in order to promote comfort and avoid or alleviate backache. While seats with relatively gradually curved cushioned back support in the lumbar area have generally been employed in the manufacture of car seats, limited extra padding for optimum location in the lumbar area has been found helpful to avoid or alleviate backache, particularly in the case of extensive trips where spinal discomfort is frequently encountered.

However, it has proved difficult to standardize the location of any substantial extra lumbar support cushion due to individual size differentials and spinal variations of the occupants. Some prior attempts have been made to meet the requirement for an adjustable lumbar support through the use of Velcro attachments, multiple hook eyelets in the seat back materials, and adjustable strap attachments to the seat back.

The lumbar support of the present invention was developed primarily on the basis of reports in two published articles:

1. *SPINE,* Vol. 5, No. 2, Mar./Apr. 1980: "Relation Between the Structure of the Annulus Fibrosis and the Function and Failure of the Intervertebral Disc"—Stephen Hickey and David Hukins 2. *SPINE,* Vol. 4, No. 1, January/February 1979: "The Influence of Backrest Inclination and Lumbar Support on Lumbar Lordosis"—G. Anderson, R. Murphy, R. Ortengren, and A. Nachemson

BRIEF DESCRIPTION OF THE PRESENT INVENTION

According to criteria based on research described in the above articles and others, the degree of lumbar curvature necessary from the support, and degree of inclination were assessed and developed. The density of the lumbar support and the shape were based on clinical research in applicant's physical therapy practice.

Adjustable height was the main feature in order to accommodate optimum requirements for varying heights and spinal characteristics of the individual occupant.

In order to provide an attractive seat attachment which would include a vertically adjustable lumbar support cushion with completely concealed adjustment means, applicants devised a plastic sheet or optionally wire frame with a fabric envelope enclosure having an interior expandable chamber for a universally adequate vertically adjustable lumbar support cushion. The adjustable lumbar support cushion is connected on its back to an adjustment strap passing through the back fabric of the envelope with ends joined to provide an endless continuous strap for exterior manual grasp when detached from the seat back to effect a completely enclosed interior height adjustment of the lumbar support cushion.

The envelope has an expansion section to accommodate the cushion in any vertical position of adjustment with upper and lower limits where the two-plys of cover fabric are suitably joined. A lower tail flap is provided for insertion between the seat and seat back of a conventional car seat and upper back straps are provided to encircle the seat back of any individual seat to which attachment may be made with elastic strap material and Velcro ends to accommodate varying seat back widths and thicknesses. Such attachment straps are loosened to accommodate adjustment of the lumbar support location after which they are connected behind the seat back, completely concealing the manual adjustment strap.

DETAILED DESCRIPTION OF PREFERRED EMBODIMENT

Figure 1:
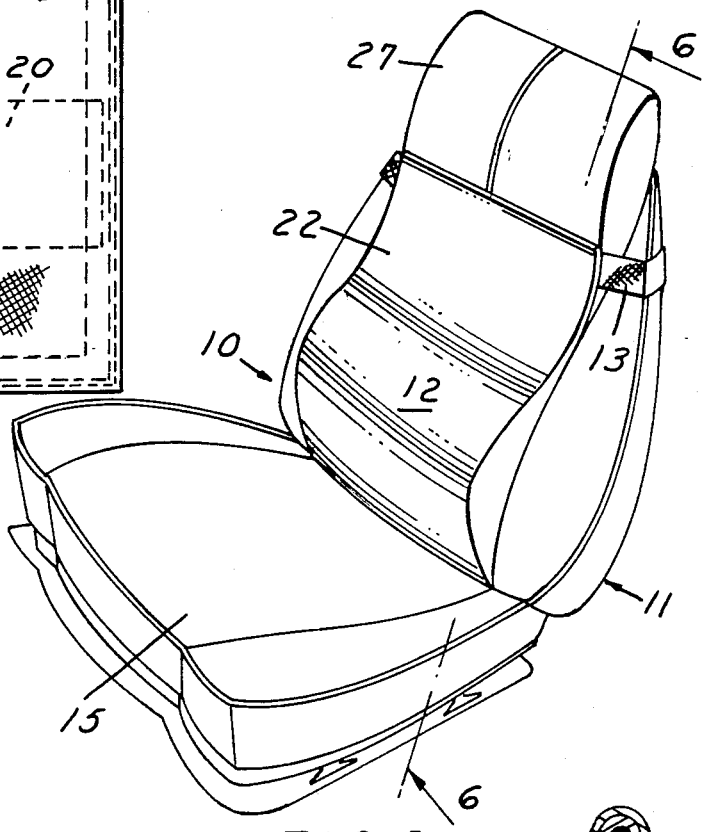
FIG. 1 is a frontal perspective view of a seat with the lumbar support of the present invention installed.
Figure 2:
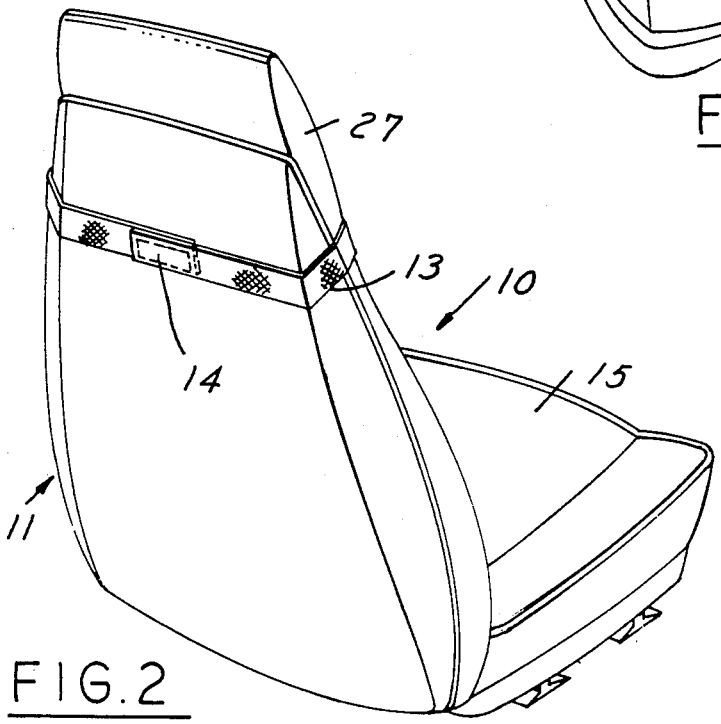
FIG. 2 is a perspective view of the car seats shown in FIG. 1.

With reference to FIGS. 1 and 2, car seat 10 with individual back rest 11 is equipped with detachable lumbar support 12 of the present invention. The support is attached to back rest 11 by elastic straps 13 having Velcro connection 14 at the rear of the back rest. Flap 14 at the lower end is tucked in between seat cushion 15 and back rest 11 to complete the installation.

Figure 3:
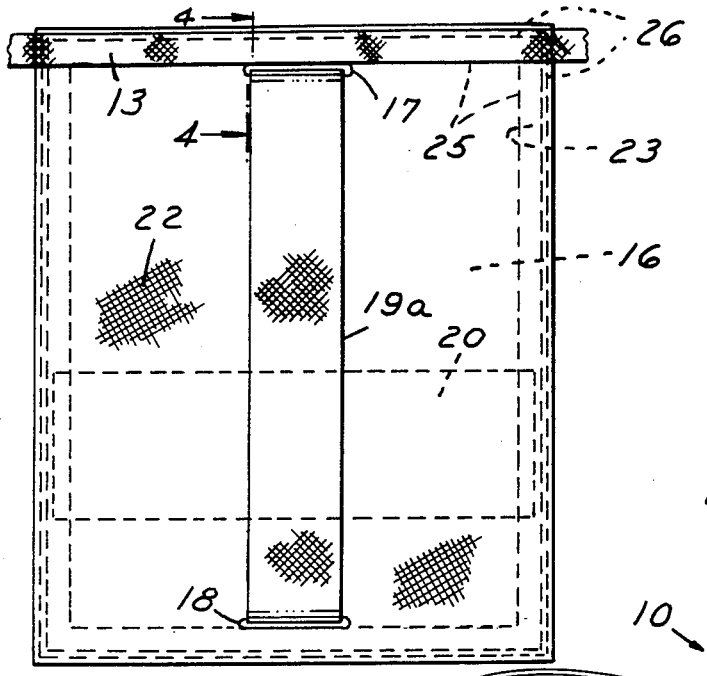
FIG. 3 is a rear elevation of the lumbar support per se.
Figure 4:
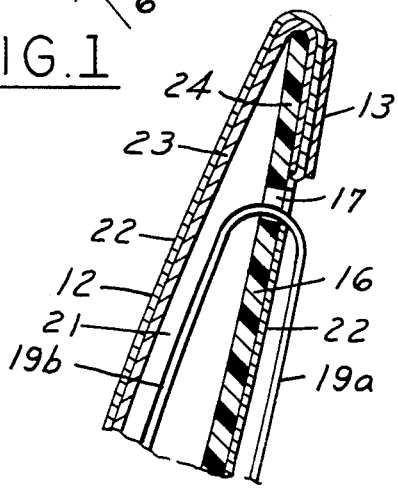
FIG. 4 is a fragmentary sectional view taken along the line 4—4 of FIG. 3.
Figure 5:
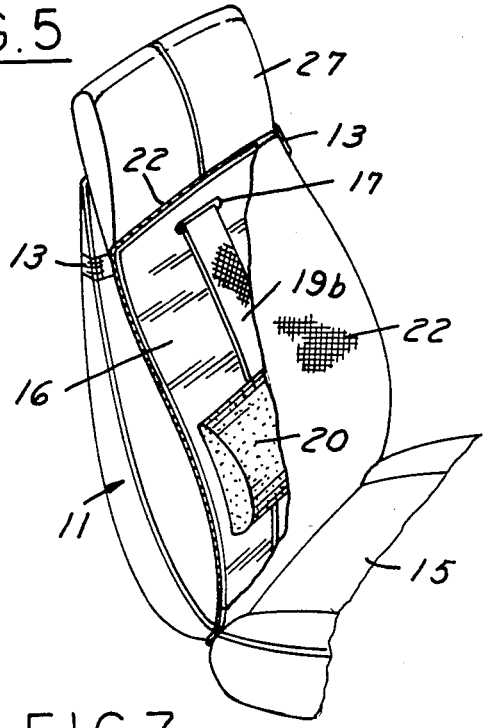
FIG. 5 is a frontal perspective view similar to FIG. 1 with the outer fabric opened to illustrate internal construction.
Figure 6:
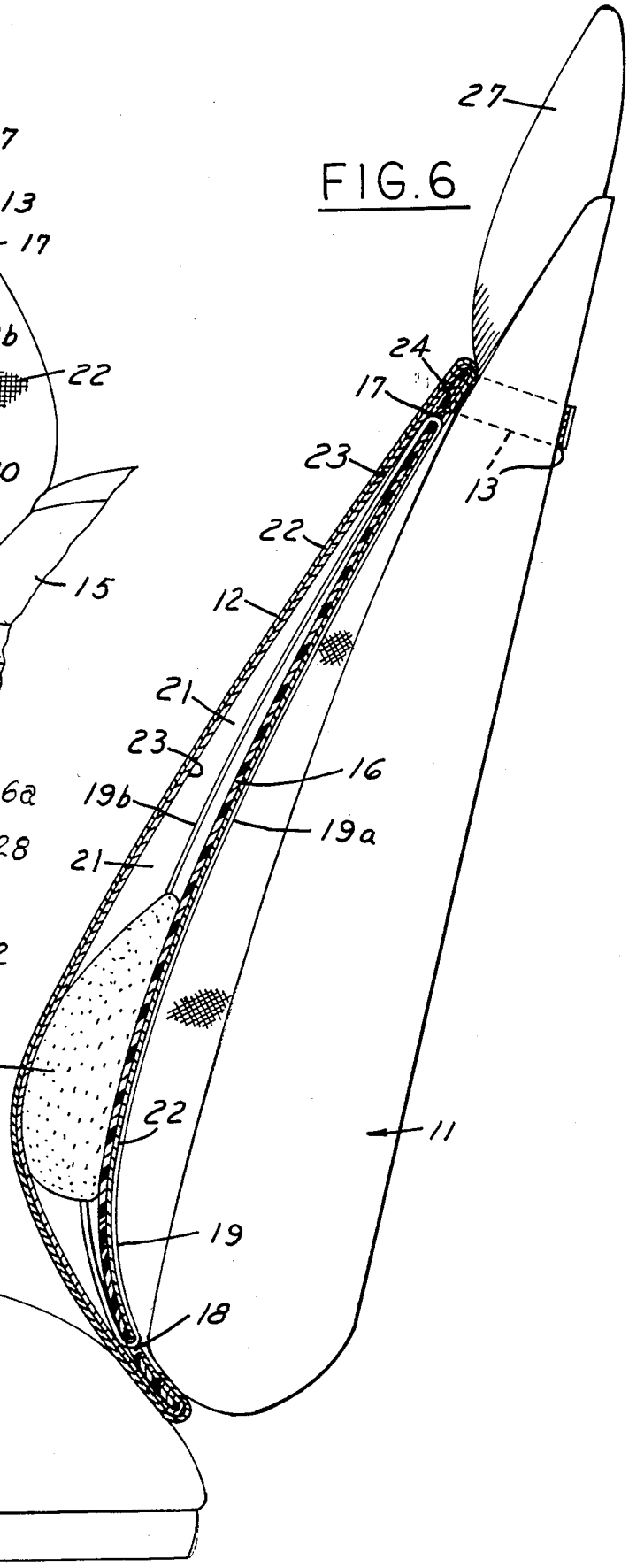
FIG. 6 is a sectional side elevation taken along line 6—6 of FIG. 1.

As best shown in FIG. 6, a plastic somewhat flexible internal frame 16 has an upper slot opening 17 and lower slot opening 18 for passages of belt 19 having an outer portion **19*a*, accessible for manual grasping when straps 13 are loosened and the lumbar support is moved away from back rest 11, and an internal portion 19*b* attached by suitable means to foam cushion 20 and vertically adjustable in envelope space 21 through manipulation of belt portion 19*a*. Outer fabric cover 22, preferably Velour material, extends over adjustable lumbar cushion 20 over the ends of plastic frame 16 as well as its back surface to which it is adhesively attached. Inner pad 23 of suitable backing material forms a liner for outer fabric 22 terminating around the upper ends 24 of plastic frame 16 as best shown in FIG. 4. As also shown in FIG. 3, edges 25 of inside pad 23 may be turned over frame edges 26 being glued thereto for retention. The upper end of the lumbar support is adapted to fit closely against the vehicle seat back 11 under the conventional extensible seat back head rest 27**.

Figure 7:
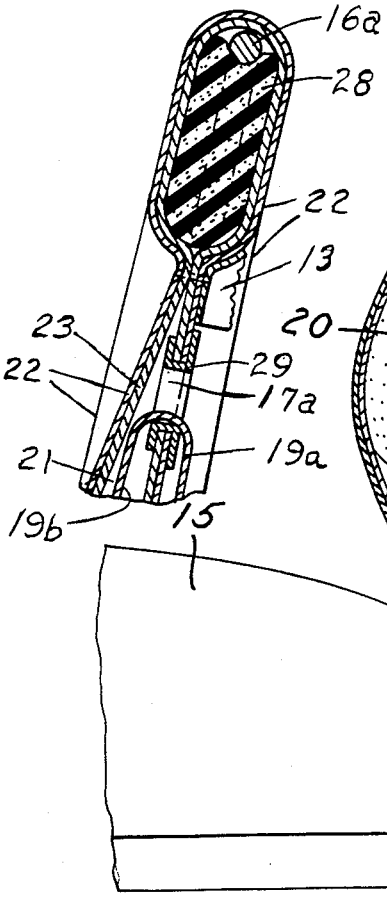
FIG. 7 is a fragmentary sectional view similar to FIG. 4 illustrating an optional wire frame construction.

With reference to FIG. 7, a modified rectangular wire frame **16*a* may be employed in place of plastic frame 16 extending around the inside perimeter of the lumbar support and the top of an upper foam pad 28. Belt openings 17*a* are provided by metal grommets 29 secured to fabric 22 and liner 23 in lieu of slots 17 in the plastic frame 16**.

We claim:

1. In combination, an individual seat having a lower seat element and a seat back with its lower extremity closely adjacent said lower seat element, an adjustable accessory lumbar support removably attached to said seat back comprising a rectangular perimeter frame, a fabric envelope enclosing said frame, said envelope having an expandable chamber, an enclosed vertically adjustable lumbar support cushion within said chamber, said cushion having a flat rearward portion and a vertically arcuate lumbar support portion extending horizontally within the perimeter of said frame, a vertical strap attached to said cushion, top and bottom passages in the back of said envelope at the extremities of adjustment with reinforced eyelets for passage of said vertical strap, said strap extending in a continuous strand outside of the back of said fabric envelope through said respective passages manually engageable for vertical adjustment of said lumbar support cushion in either direction within the extremities of said adjustment, said strap normally engaging and being concealed by said seat back but accessible upon removal of said accessory lumbar support from said seat back fro manual vertical adjustment of said cushion within said envelope, said fabric envelope having layers of material attached together at upper and lower extremitites of said expandable chamber, a depending flap extending from said lower extremity of attached envelope layers for frictionally retained insertion between said lower seat element and seat back, a fixed cushion extending above said upper extremity of attached envelope layers, horizontal back strap means at said upper extremity for removable attachment of said accessory lumbar support to said seat back in a predetermined fixed vertical position accommodating said lower flap retention between seat element and seat back.

2. Lumbar support of claim 1 wherein said back strap means are elastic material with Velcro end attachments.

3. Lumbar support of claim 1 wherein said lumbar support cushion is constructed of foam rubber.

4. Lumbar support of claim 1 wherein said frame comprises a rectangular wire insert, and said eyelets for said strap are provided which comprise reinforced metal grommets through the back of said envelope.

* * * * *